US008427310B2

(12) United States Patent
Kernwein

(10) Patent No.: US 8,427,310 B2
(45) Date of Patent: Apr. 23, 2013

(54) METHOD, SYSTEM AND APPARATUS FOR MONITORING LAMP CIRCUITS IN A CAB SIGNAL SYSTEM

(75) Inventor: Jeffrey D. Kernwein, Cedar Rapids, IA (US)

(73) Assignee: Wabtec Holding Corp., Wilmerding, PA (US)

( * ) Notice: Subject to any disclaimer, the term of this patent is extended or adjusted under 35 U.S.C. 154(b) by 674 days.

(21) Appl. No.: 12/595,895

(22) PCT Filed: May 1, 2008

(86) PCT No.: PCT/US2008/062149

§ 371 (c)(1),
(2), (4) Date: Oct. 14, 2009

(87) PCT Pub. No.: WO2008/137501

PCT Pub. Date: Nov. 13, 2008

(65) Prior Publication Data

US 2010/0127861 A1 May 27, 2010

Related U.S. Application Data

(60) Provisional application No. 60/927,419, filed on May 3, 2007.

(51) Int. Cl.
*G08B 21/00* (2006.01)

(52) U.S. Cl.
USPC ..... 340/540; 246/121; 701/19

(58) Field of Classification Search ..... 340/540, 340/458, 641, 642; 701/19; 246/121, 125, 246/220, 187 R
See application file for complete search history.

(56) References Cited

U.S. PATENT DOCUMENTS

| | | | |
|---|---|---|---|
| 2,464,978 | A | 3/1949 | Hines |
| 4,068,216 | A | 1/1978 | Brouwer et al. |
| 4,259,659 | A | 3/1981 | Ariyoshi et al. |
| 4,314,234 | A | 2/1982 | Darrow et al. |
| 4,349,810 | A | 9/1982 | Kugo et al. |
| 6,349,248 | B1 | 2/2002 | Dean et al. |
| 6,369,704 | B2 | 4/2002 | Hilleary |
| 6,518,782 | B1 | 2/2003 | Turner |
| 6,597,179 | B2 | 7/2003 | St-Germain |
| 6,624,638 | B2 | 9/2003 | St-Germain |
| 6,763,290 | B2 | 7/2004 | Johnson |
| 7,098,774 | B2 | 8/2006 | Davenport et al. |
| 7,123,165 | B2 | 10/2006 | Davenport et al. |
| 7,154,403 | B2 | 12/2006 | Davenport et al. |
| 2005/0062481 | A1 | 3/2005 | Vaughn et al. |
| 2006/0066447 | A1 | 3/2006 | Davenport et al. |
| 2006/0155445 | A1 | 7/2006 | Browne et al. |

*Primary Examiner* — Jeffery Hofsass

(74) *Attorney, Agent, or Firm* — The Webb Law Firm

(57) ABSTRACT

A fault detection system (10) and computer-implemented method for detecting a fault in a cab signal system (100), including: a plurality of sensors (12) in electrical communication with a cab signal display circuit (106), each associated with a respective one of a plurality of lamp circuits (108) and configured to sense or measure: presence or absence of voltage, voltage level, voltage drop, presence or absence of current and/or current level. A monitoring unit (14) is in communication with the plurality of sensors (12) and generates circuit data (16) representative of at least one condition of at least a portion of the cab signal system (100). A computer-implemented method for detecting a cab signal aspect of a train (T) is also disclosed.

21 Claims, 1 Drawing Sheet

METHOD, SYSTEM AND APPARATUS FOR MONITORING LAMP CIRCUITS IN A CAB SIGNAL SYSTEM

BACKGROUND OF THE INVENTION

1. Field of the Invention

The present invention relates generally to train control systems and, in particular to a method, system and apparatus for monitoring in a cab signal system of a train, and for ascertaining and verifying the integrity of a cab signal system, detecting the existence of a fault in the cab signal system and/or detecting a signal aspect in the cab signal system.

2. Description of Related Art

In-cab signaling systems are used to provide an operator of a locomotive with information about the signal aspects for the block of track in which the locomotive is operating. According to such known systems, certain sensing devices are situated near a rail in order to pick up low frequency signals that correlate to certain aspects in a locomotive cab. These low frequency signals are processed by a cab signal control unit, and the resultant information and data is then sent to a cab signal aspect display unit for viewing by the operator. Normally, the signal aspect is indicated to the operator of the train through the use of lamps, e.g., an incandescent lamp, light emitting diode, etc., with each lamp corresponding to a specific signal aspect. Specific train control decisions and operations must be implemented, whether manually or automatically, based upon the provided indication of the signal aspect. Accordingly, the integrity of the entire cab signal system is deemed to be very important, as it conveys safety critical information to the operator, which is vital for safe train operation.

As stated, known cab signal systems are used extensively throughout the railroad industry and represent units that are presently installed on numerous trains and locomotives. The signal aspect information, which is indicated to the operator using the lamps, is also required for use in effectively operating a train control unit or train control system, such as the Electronic Train Management System (ETMS) of Wabtec. Therefore, this signal aspect information must be conveyed to a train control unit, which may not be easily integrated with the cab signal control unit. Therefore, other manners of obtaining or determining this signal aspect data are useful, especially in situations where the cab signal system is already installed and operating on the train.

According to the prior art, there are various methods, apparatus and systems available for monitoring and detecting cab signal conditions, as well as for detecting faults or outage in lights, indicators, flashers, displays, bulbs and the like. For example, see U.S. Pat. Nos. 7,154,403 to Davenport et al.; 7,123,165 to Davenport et al.; 7,098,774 to Davenport et al.; 4,349,810 to Kugo et al.; 6,763,290 to Johnson; 6,624,638 to St-Germain; 6,597,179 to St-Germain; 6,369,704 to Hilleary; 6,349,248 to Dean et al.; 4,314,234 to Darrow et al.; 4,259,659 to Ariyoshi et al.; and 4,068,216 to Brouwer et al.; and U.S. Publication Nos. 2006/0066447 to Davenport et al.; and 2005/0062481 to Vaughn et al.

SUMMARY OF THE INVENTION

It is one object of the present invention to provide a method, system and apparatus for monitoring in a locomotive cab signal system that overcomes the drawbacks and deficiencies of the prior art. It is another object of the present invention to provide a method, system and apparatus for monitoring in a locomotive cab signal system that ensures that the various signal aspects encountered during operation of the locomotive may be reported with confidence. It is a further aspect of the present invention to provide a method, system and apparatus for monitoring in a locomotive cab signal system that accurately obtains or determines the current signal aspect data. It is yet another object of the present invention to provide a method, system and apparatus for monitoring in a locomotive cab signal system that determines the existence of a fault in the cab signal system or the various components that make up this system.

Accordingly, in one preferred and non-limiting embodiment, provided is a fault detection system for detecting a fault in a cab signal system, which includes a cab signal display circuit for supplying power to a plurality of lamp circuits, each associated with a respective one of a plurality of lamps in a cab signal aspect display unit on a train. The power is delivered from at least one power source controlled by a cab signal control unit. The fault detection system includes a plurality of sensors in electrical communication with the cab signal display circuit, each associated with a respective one of the plurality of lamp circuits. These sensors sense or measure: presence or absence of voltage, voltage level, voltage drop, presence or absence of current and/or current level. Further, a monitoring unit is in communication with the sensors and generates circuit data representative of at least one condition of at least a portion of the cab signal system.

In another preferred and non-limiting embodiment, provided is a computer-implemented method for detecting a fault in a cab signal system including a cab signal display circuit for supplying power to a plurality of lamp circuits each associated with a respective one of a plurality of lamps in a cab signal aspect display unit on a train, wherein the power is delivered from at least one power source controlled by a cab signal control unit. The method includes: providing a plurality of sensors in electrical communication with the cab signal display circuit, each associated with a respective one of the plurality of lamp circuits; sensing or measuring, by the plurality of sensors, at least one of the following: presence or absence of voltage, voltage level, voltage drop, presence or absence of current, current level, or any combination thereof; and generating circuit data representative of at least one condition of at least a portion of the cab signal system.

In a still further preferred and non-limiting embodiment, provided is a computer-implemented method for detecting a cab signal aspect of a train having a cab signal system with a cab signal display circuit for supplying power to a plurality of lamp circuits each associated with a respective one of a plurality of lamps in a cab signal aspect display unit on the train, wherein the power is delivered from at least one power source controlled by a cab signal control unit. The method includes: providing a plurality of sensors in electrical communication with the cab signal display circuit, each associated with a respective one of the plurality of lamp circuits; sensing or measuring, by the plurality of sensors, at least one of the following: presence or absence of voltage, voltage level, voltage drop, presence or absence of current, current level, or any combination thereof; generating circuit data representative of at least one condition of at least a portion of the cab signal system; and based upon the circuit data, determining the cab signal aspect of the train.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

Figure 1:
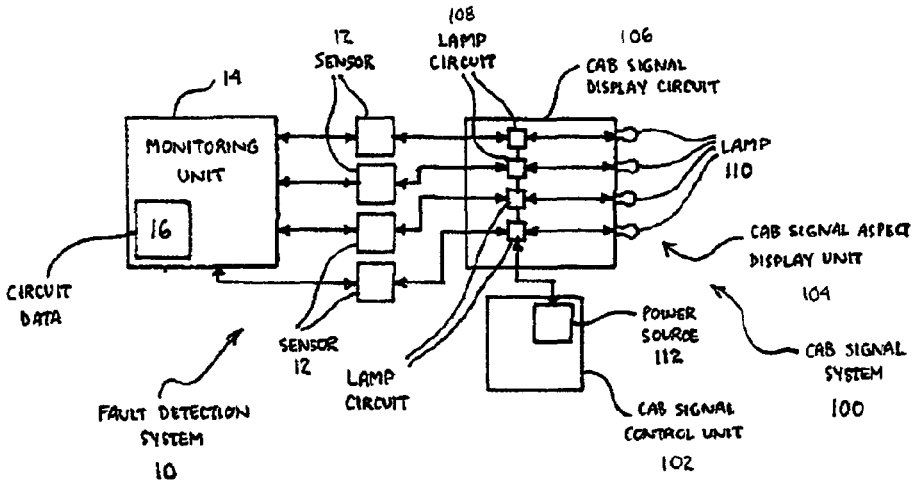
FIG. 1 is a schematic view of one embodiment of a system and apparatus for monitoring in a locomotive cab signal system according to the principles of the present invention.
Figure 2:
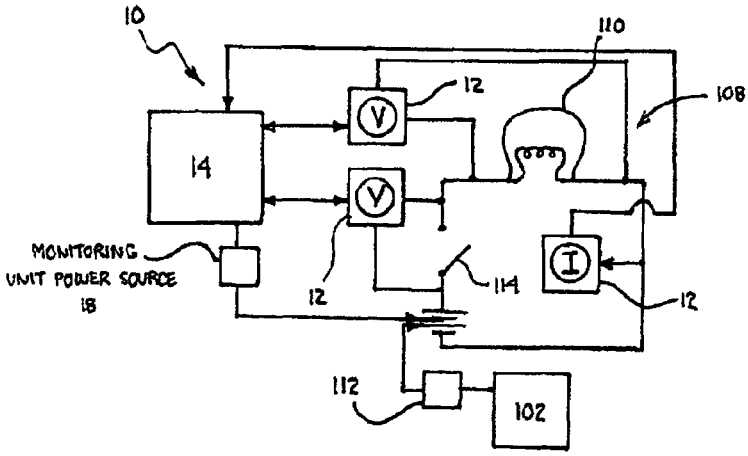
FIG. 2 is a schematic view of another embodiment of a system and apparatus for monitoring in a locomotive cab signal system according to the principles of the present invention.
Figure 3:
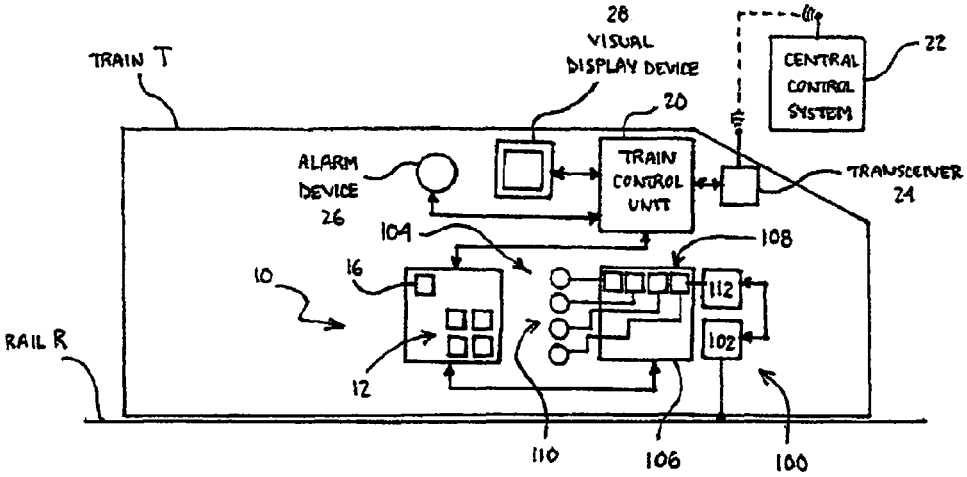
FIG. 3 is a schematic view of a further embodiment of a system and apparatus for monitoring in a locomotive cab signal system according to the principles of the present invention.

The present invention is directed to a fault detection system 10, which is illustrated in various preferred and non-limiting embodiments in FIGS. 1-3. This system 10 is configured to be implemented with and in communication with a cab signal system 100 of a train T. As discussed above, such cab signal systems 100 are known in the railroad industry, and generally include a cab signal control unit 102 and a cab signal aspect display unit 104, and the cab signal control unit 102 and cab signal aspect display unit 104 are in electrical communication through a cab signal display circuit 106. In particular, the cab signal display circuit 106 is used to supply or deliver power to multiple lamp circuits 108, and each lamp circuit 108 is associated with a respective lamp 110. Further, the power is supplied or delivered from a power source 112, which is controlled by the cab signal control unit 102.

In operation, and also according to the prior art, the cab signal control unit 102 commands or instructs the power source 112 to deliver power to one or more of the lamp circuits 108, which thereby cause the lamps 110 to light. In this manner, the lamps 110 (as part of the cab signal aspect display unit 104) provide a visual indication of the current cab signal aspect, which is normally picked up or received by the cab signal control unit 102 through the rails R upon which the train T is traversing. Accordingly, each of the lamps 110 is associated with a respective cab signal aspect of the train T, and this cab signal aspect may be a state or condition of a current section of track, a state or condition of an upcoming section of track, a clear condition, an advance approach condition, an approach condition, a restricted condition, etc. These states and/or conditions of the track, e.g., a block or section of track, are indicated or provided to the operator of the train T for use in making train control decisions.

As also known, the cab signal system 100 may use various techniques to ensure that the integrity of the cab signal system 100 is maintained throughout the system 100, such as from the rail sensors to the cab signal aspect display unit 104 and all communications therebetween. However, prior art cab signal systems 100 are often limited in their ability to act upon, or display restrictions, beyond the block of track in which the train T is operating, or the upcoming block. Communication-based train control systems have the added benefit of utilizing other information, such as temporary speed restrictions or work zone restrictions, to provide additional protection in cab-signal territory. Accordingly, the system 10 of the present invention assists in ensuring that such information and data is appropriately conveyed to the operator and that no miscommunication occurs due to lack of activation or signaling of a corresponding lamp 110 in the cab signal aspect display unit 104.

Also according to the prior art, the cab signal system 100 includes self-monitoring functions to ensure that the system 100 is operative. For example, if a lamp 110 should be lit and displaying a specified cab signal aspect, the cab signal control unit 102 may periodically provide a zero-voltage pulse to ensure that the lamp 110 can be turned off. For example, a pulse width of no-voltage of 2.5 ms may be provided when the lamp 110 is on. Similarly, a specified voltage may be supplied, briefly and periodically, to those lamps 110 that should be off, thus ensuring that they may be appropriately turned on. For example a pulse width of an appropriate voltage, e.g., 32 volts, may be 500μ when the lamp 110 is off. By observing these brief test signals, the cab signal control unit 102 makes a determination of whether the lamp 110 is functioning in an appropriate manner.

Accordingly, and in one preferred and non-limiting embodiment, the system 10 of the present invention may be utilized in connection with existing cab signal systems 100, without the normally-required substantial modification of the software (and hardware) for operating the cab signal system 100. Therefore, the system 10 may be a retrofittable system or unit, as discussed in detail hereinafter. Of course, it is also envisioned that the system 10 of the present invention can be equally effective, utilized and/or implemented with a new cab signal system 100 positioned on the train T.

One preferred and non-limiting embodiment of the system 10 is illustrated in FIG. 1. In this embodiment, the system 10 includes multiple sensors 12 that are placed or positioned to allow for electrical communication with at least a portion of the cab signal display circuit 106. In particular, and since there are multiple lamp circuits 108 for driving or lighting a respective lamp 110, a respective sensor 12 is placed in electrical communication with each lamp circuit 108. Further, these sensors 12 are used to sense or measure the presence or absence of voltage, a voltage level, a voltage drop, the presence or absence of current and/or a current level. Still further, a monitoring unit 14 is in communication with these sensors 12, and based upon the information and data provided by these sensors 12, the monitoring unit 14 generates circuit data 16 representative of at least one condition of at least a portion of the cab signal system 100.

In one embodiment, a sensor 12 senses or measures current delivered to or existing within a respective lamp circuit 108. Based upon this information, the monitoring unit 14 can determine the state, i.e., active or inactive, of the lamp circuit 108. As discussed hereinafter, the location of the sensor 12 in the lamp circuit 108 can be varied in order to appropriately determine which lamp circuit 108 is active, which lamp 110 is operable, or other information regarding the cab signal display circuit 106. Based upon the information obtained from the sensors 12, the monitoring unit 14 generates the circuit data 16, which can provide different and useful information. For example, this circuit data 16 may indicate which of the lamp circuits 108 maintains a specified voltage level, which lamp circuit 108 exhibits no voltage, which lamp circuit 108 exhibits a pulse of a specified voltage level, which lamp 110 is lit, which lamp 110 should be lit, which lamp 110 should not be lit, a condition of the monitoring unit 14, a condition of the cab signal aspect display unit 104, a condition of the cab signal control unit 102, a condition of the cab signal system 100, a cab signal aspect, etc. By using the data generated by the sensors 12, the monitoring unit 14 can make any of the above-listed determinations. Further, these determinations can be made using sensors 12 positioned throughout the cab signal display circuit 106, and further, the sensors 12 may take a variety of forms, e.g., a voltmeter, an ohmmeter, a current sensor, etc. Regardless, it is the sensors 12 in the fault detection system 10 that sense or measure electrical signals for provision to the monitoring unit 14, which processes the obtained signals and makes the required determinations.

In one preferred and non-limiting embodiment, based upon the circuit data 16, the monitoring unit 14 determines which of the lamp circuits 108 is maintaining a specified voltage level, thereby identifying the active lamp circuits 108. Of course, in a preferred and normal operating situation, only one of the multiple lamp circuits 108 will be active, such that only one of the corresponding lamps 110 will be lit and provide the appropriate indication to the operator. Next (or by using the above determination), the monitoring unit 14 determines which of the lamp circuits 108 exhibits no voltage, thereby identifying the inactive lamp circuits 108. Again, if none of the lamp circuits 108 is active, this may also indicate a fault or other operating error within the cab signal system 100.

As discussed hereinafter, determining whether a lamp 110 is burned out or not working (or a corresponding switch), or even the power source 112 or cab signal control unit 102, the sensors 12 may be positioned in specified circuit paths. However, if the switches and lamps 110 are operating appropriately, and only one lamp 110 is lit (i.e., one lamp circuit 108 is active), the circuit data 16 includes the determination that the state or condition of the signal aspect is the state or condition corresponding to the lit lamp 110 and/or active lamp circuit 108. Similarly, if the remaining lamp circuits 108 and/or lamps 110 are inactive or unlit, this provides further verification that the correct and current cab signal aspect is that of the active lamp circuit 108 and lamp 110. Accordingly, the monitoring unit 14 can drive the cab signal aspect based upon the electrical information obtained through the sensors 12.

As further insurance that the cab signal control unit 102 (and cab signal system 100 generally) are operating appropriately, the sensors 12 may also be configured to sense the pulses of voltage or no voltage discussed above in connection with known cab signal systems 100. In particular, for the lamp circuit 108 that was determined to be active, the monitoring unit 14 may further determine whether the periodic pulse of no voltage is present. In addition, and for the inactive lamp circuits 108, the monitoring unit 14 may determine whether a periodic pulse of a specified voltage level is present. Based upon these determinations, the monitoring unit 14 may infer whether the cab signal control unit 102 is appropriately operating and sending the required pulses testing the lamp circuits 108 within the cab signal system 100. Accordingly, not only can the system 10 of the present invention determine the current cab signal aspect based upon the circuit data 16, but also the appropriate functioning of the cab signal control unit 102 in the cab signal system 100.

In another aspect of the present invention, the system 10 can be used to determine the appropriate functioning of the various components of the cab signal display circuit 106. For example, a sensor 12 may be in electrical communication with a specified lamp circuit 108, such as a current sensor for measuring current flowing through the lamp circuit 108, and this information provided to the monitoring unit 14. Similarly, the cab signal display circuit 106 may include a switch 114, which is activatable to allow power to be delivered from the power source 112 through the lamp circuit 108 into the lamp 110. Specifically, when the switch 114 is closed, power is delivered from the power source 112 to the lamp 110, and when the switch 114 is open, the power is not delivered from the power source 112 to the lamp 110. A sensor 12 may be used to sense or measure voltage across this switch 114. Such an arrangement is illustrated in FIG. 2. In operation, if the switch 114 is broken and cannot close, the sensor 12 would sense the current delivered from the power source 112. Alternatively, if the switch 114 was broken shut, the power or current would not travel through the sensor 12, and instead continue to be delivered through the switch 114. Therefore, based upon the commands given from the cab signal control unit 102 through the power source 112 to the switch 114, it can be determined if the switch 114 is operational.

Alternatively, if it is the cab signal control unit 102 and/or the power source 112 that has become inoperative (as opposed to the switch 114 or lamp 110), it is further envisioned that the system 10 include a monitoring unit power source 18. In particular, and based upon the control by the monitoring unit 14, power can be delivered from the monitoring unit power source 18 to the switch 114 and bypass the power source 112 of the cab signal control unit 102. This would help in isolating whether there is a problem with the switch 114 or the power source 112/cab signal control unit 102.

In addition, a sensor 12 may be placed in the lamp circuit 108 on either side of the lamp 110 (resistor). Whether or not current is detected by the sensor 12 running through the lamp 110 will help in establishing whether the lamp 110 is burned out and requires maintenance. Similarly, and as discussed above, the monitoring unit power source 18 may also selectively power this switch 114 and lamp circuit 108 (and, thus, the lamp 110) and help in determining whether it is the lamp 110 that is burned out, or there is some other problem with the power source 112 or cab signal control unit 102. Using a variety of sensors 12 in connection with a single lamp circuit 108 would help in accurately identifying false or other functional failures in the cab signal display circuit 106, the lamp circuit 108, the lamp 110, the switch 114, the power source 112, the cab signal control unit 102, or, generally, the cab signal system 100. Still further, it is envisioned that the monitoring unit power source 18 may use the "false" technique described above in connection with the cab signal control unit 102, i.e., pulsing the specified lamp circuit 108 to determine operability of the lamp circuit 108 and/or corresponding lamp 110. In addition, it is envisioned that the system 10 can be configured to interact directly with the cab signal control unit 102 to determine appropriate communication in operation.

A further preferred and non-limiting embodiment of the system 10 of the present invention is illustrated in FIG. 3. In this embodiment, the monitoring unit 14 may be in communication with the cab signal system 100, the cab signal control unit 102, a train control unit 20, a central control system 22 or similar systems and components of the train T. As discussed above, the system 10 is particularly useful in providing for efficient and effective communication of data, e.g., cab signal aspect data, between the cab signal system 100 and the train control unit 20, which is used to provide for the automated or semi-automated control of the train T. As is known, the train control unit 20 may include or communicate with a transceiver 24, which may be used to communicate, normally wirelessly, with the central control system 22. This central control system 22 may be the central dispatch system of the railway and, accordingly, the appropriate circuit data or other determinations made by the monitoring unit 14 can be communicated to the central control system 22 through the train control unit 20. This would allow the central control system 22 to identify which trains have faults or other operational errors occurring onboard the train T, and allow for the appropriate resolution thereof.

In addition, the existence of a faulty condition or other determination that requires communication to the operator may occur through the use of an alarm device 26 and/or a visual display device 28. Accordingly, this visual display device 28 may be part of the cab signal aspect display unit 104, or a separate visual display unit that can provide audio visual data content to the operator. Also, and as discussed above, a message or other information can be transmitted to the central control system 22 for use in logging the faulty operation, such that repairs can be immediately initiated upon arrival of the train T at an upcoming service depot. Similarly, the alarm device 26 may provide an oral or visual alert to the operator regarding any faults, errors, functional failures, etc. existing in the cab signal system 100. Therefore, the alarm device 26 and/or visual display device 28 may be used to provide an indication to the operator of the train T regarding the condition or state of the cab signal system 100, the cab signal display circuit 106, the lamp circuits 108, the lamps 110, the power source 112, the cab signal control unit 102, the sensors 12, the monitoring unit 14, the monitoring unit power source 18, a cab signal aspect, the train T, the train control unit 20, the central control system 22, etc. This data or indicator (provided through either the alarm device 26 or the visual display device 28) may indicate the normal operation of any of these systems or sub-systems, or as discussed, a fault or improper functioning in one of these systems or sub-systems.

The system 10 may be integrated within an originally-installed cab signal system 100 or, alternatively, may be installed as an after-working component. Further, the system 10 may be embodied as a hardware unit with the necessary software and electrical and communicative connections for integration with the cab signal system 100 and/or the train control unit 20. Still further, the system 10 may be a sub-system component of the overall train control unit 20 and either the cab signal system 100 or train control unit 20 may be updated with the necessary software for implementing the system 10 of the present invention. It is to be understood that the aforementioned system 10 is envisioned to be used in train control systems that rely upon existing cab signal system 100 equipment as a source of input, but that the system 10 may be integrated into other train control systems with the appropriate modifications.

In this manner, the system 10 of the present invention provides a method, system and apparatus for monitoring in a cab signal system 100 that ensures that the various signal aspects encountered during operation of the train T may be reported with confidence. In addition, the system 10 (and methods described herein) allow for the accurate determination of the current signal aspect data, as well as the existence of a fault or other improper functioning component of the cab signal system 100, or various other components that make up the system 10. Therefore, the present invention allows for increased transparency and the data communication amongst the various systems installed on a train T.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A fault detection system for detecting a fault in a cab signal system including a cab signal display circuit for supplying power to a plurality of lamp circuits each associated with a respective one of a plurality of lamps in a cab signal aspect display unit on a train, the power delivered from at least one power source controlled by a cab signal control unit, the fault detection system comprising:

a plurality of sensors in electrical communication with the cab signal display circuit, each associated with a respective one of the plurality of lamp circuits and configured to sense or measure at least one of the following: presence or absence of voltage, voltage level, voltage drop, presence or absence of current, current level, or any combination thereof; and a monitoring unit in communication with the plurality of sensors and configured to generate circuit data representative of at least one condition of at least a portion of the cab signal system.

2. The system of claim 1, wherein at least one of the plurality of sensors senses or measures current delivered or existing within at least one of the plurality of lamp circuits.

3. The system of claim 1, wherein the circuit data indicates at least one of the following: which of the plurality of lamp circuits maintains a specified voltage level, which of the plurality of lamp circuit exhibits no voltage, which of the plurality of lamp circuits exhibits a pulse of a specified voltage level, which of the plurality of lamp circuits exhibits a pulse of no voltage, which of the plurality of lamps is lit, which of the plurality of lamps should be lit, which of the plurality of lamps should not be lit, a condition of the monitoring unit, a condition of the cab signal aspect display unit, a condition of the cab signal control unit, a condition of the cab signal system, a cab signal aspect or any combination thereof.

4. The system of claim 1, wherein, based upon the circuit data, the monitoring unit is further configured to:

(a) determine which of the plurality of lamp circuits is maintaining a specified voltage level, thereby identifying at least one active lamp circuit;

(b) determine which of the plurality of lamp circuit exhibits no voltage, thereby identifying at least one inactive lamp circuit;

(c) for the at least one active lamp circuit, determine whether at least one pulse of no voltage is periodically present;

(d) for the at least one inactive lamp circuit, determine whether at least one pulse of a specified voltage level is periodically present; and (e) derive the circuit data from at least one of determination (a)-(d).

5. The system of claim 4, wherein each of the plurality of lamps is associated with a respective cab signal aspect of the train and, based upon the circuit data, the monitoring unit is further configured to determine a current cab signal aspect.

6. The system of claim 1, wherein each of the plurality of lamps is associated with a respective cab signal aspect of the train and, based upon the circuit data, the monitoring unit is further configured to determine a current cab signal aspect.

7. The system of claim 1, wherein, based upon the circuit data, the monitoring unit is further configured to determine which of the plurality of lamp circuits is active.

8. The system of claim 1, wherein, based upon the circuit data, the monitoring unit is further configured to determine which of the plurality of lamps is lit.

9. The system of claim 1, wherein the cab signal display circuit includes a switch in electrical communication with the at least one lamp, such that when the switch is closed, power is delivered from the power source to the at least one lamp, and when the switch is opened, power is not delivered from the power source to the at least one lamp, and wherein at least one of the plurality of sensors senses or measures voltage across the switch.

10. The system of claim 1, wherein at least one of the plurality of sensors senses or measures voltage across the lamp.

11. The system of claim 1, wherein at least one of the plurality of sensors senses or measures current in at least one of the following: the cab signal display circuit, at least one of the plurality of lamp circuits or any combination thereof.

12. The system of claim 1, wherein at least one of the plurality of sensors senses or measures a command signal transmitted from the cab signal control unit to the power source.

13. The system of claim 1, further comprising a monitoring unit power source controlled by the monitoring unit and configured to selectively deliver power or terminate power delivery to the cab signal display circuit.

14. The system of claim 1, wherein the monitoring unit is in communication with at least one of the following: the cab signal system, the cab signal control unit, a train control unit, a central control system or any combination thereof, and configured to at least one of transmit, receive or process data.

15. The system of claim 1, wherein the "ON" or "OFF" condition of each of the plurality of lamps provides a visual indication to an operator of cab signal aspect of the train.

16. The system of claim 15, wherein the cab signal aspect is at least one of the following: a state or condition of a current section of track, a state or condition of an upcoming section of track, a clear condition, an advance approach condition, an approach condition, a restricted condition or any combination thereof.

17. The system of claim 1, further comprising an alarm device configured to provide an alarm to an operator of the train based upon at least one condition or state of at least one of the following: the cab signal system, the cab signal display circuit, at least one of the plurality of lamp circuits, at least one of the plurality of lamps, the power source, the cab signal control unit, at least one of the plurality of sensors, the monitoring unit, a monitoring unit power source, a cab signal aspect, the train, a train control unit, a central control system or any combination thereof.

18. The system of claim 1, further comprising a visual display device configured to present data to an operator of the train, the content of the data at least partially representing at least one condition or state of at least one of the following: the cab signal system, the cab signal display circuit, at least one switch in the cab signal display circuit, at least one of the plurality of lamp circuits, at least one of the plurality of lamps, the power source, the cab signal control unit, at least one of the plurality of sensors, the monitoring unit, a monitoring unit power source, a cab signal aspect, the train, a train control unit, a central control system or any combination thereof.

19. The system of claim 1, wherein, based upon the circuit data, the monitoring unit is further configured to determine the existence of a fault or improper functioning in at least one of the following: the cab signal system, the cab signal display circuit, at least one switch in the cab signal display circuit, at least one of the plurality of lamp circuits, at least one of the plurality of lamps, the power source, the cab signal control unit, at least one of the plurality of sensors, the monitoring unit, a monitoring unit power source, a cab signal aspect, the train, a train control unit, a central control system or any combination thereof.

20. A computer-implemented method for detecting a fault in a cab signal system including a cab signal display circuit for supplying power to a plurality of lamp circuits each associated with a respective one of a plurality of lamps in a cab signal aspect display unit on a train, the power delivered from at least one power source controlled by a cab signal control unit, the method comprising:

providing a plurality of sensors in electrical communication with the cab signal display circuit, each associated with a respective one of the plurality of lamp circuits;

sensing or measuring, by the plurality of sensors, at least one of the following presence or absence of voltage, voltage level, voltage drop, presence or absence of current, current level, or any combination thereof; and generating circuit data representative of at least one condition of at least a portion of the cab signal system.

21. A computer-implemented method for detecting a cab signal aspect of a train having a cab signal system with a cab signal display circuit for supplying power to a plurality of lamp circuits each associated with a respective one of a plurality of lamps in a cab signal aspect display unit on the train, the power delivered from at least one power source controlled by a cab signal control unit, the method comprising:

providing a plurality of sensors in electrical communication with the cab signal display circuit, each associated with a respective one of the plurality of lamp circuits;

sensing or measuring, by the plurality of sensors, at least one of the following: presence or absence of voltage, voltage level, voltage drop, presence or absence of current, current level, or any combination thereof;

generating circuit data representative of at least one condition of at least a portion of the cab signal system; and based upon the circuit data, determining the cab signal aspect of the train.

* * * * *